United States Patent [19]

Palmer et al.

[11] 4,422,552

[45] Dec. 27, 1983

[54] CARD FOR MOUNTING BAGS AND THE LIKE

[75] Inventors: Charles E. Palmer, Somers; William A. Gelinas, Enfield, both of Conn.

[73] Assignee: Palmer Systems, Inc., Somers, Conn.

[21] Appl. No.: 385,881

[22] Filed: Jun. 7, 1982

[51] Int. Cl.[3] ..... G09F 1/02; B65D 73/00

[52] U.S. Cl. ..... 206/466; 206/465; 206/482; 206/526; 206/806

[58] Field of Search ..... 206/466, 465, 464, 471, 206/482, 526, 806

[56] References Cited

U.S. PATENT DOCUMENTS

| | | | |
|---|---|---|---|
| 1,402,635 | 1/1922 | Meyer | 206/466 |
| 3,753,305 | 8/1973 | Mueh | 206/806 |
| 4,312,449 | 1/1982 | Kinderman | 206/482 |

*Primary Examiner*—William T. Dixson, Jr.
*Assistant Examiner*—Brenda J. Ehrhardt

[57] ABSTRACT

A card for mounting and displaying snack foods and other products packaged in bags is provided, which has a matched pair of locking tabs defined therein. The tabs are forwardly deflected to receive the reversely folded end flange of the bag therebehind, and are then forced rearwardly through the plane of the card to position the upper corners of the bag therebehind. This will provide secure, two-point support for the product bag, while also permitting ready removal at the point of sale. Generally, a multiplicity of bags will be mounted on the card, arranged in rows and shingled columns thereon. In certain embodiments, the tabs are desirably formed with nibs on their upper edge to deform and thereby better grip the bag, as is most desirable when the bag is made of a flaccid material.

15 Claims, 9 Drawing Figures

CARD FOR MOUNTING BAGS AND THE LIKE

BACKGROUND OF THE INVENTION

Point-of-sale display cards are widely utilized as a means for dispensing small bags or packets of snack foods and other products to the customer. While such cards may assume any of several forms, the bags of product are normally either stapled to the card, or the card itself is formed with integral gripping means by which the product can be disengageably mounted. Typical of the latter are the constructions shown in U.S. Pat. Nos. 2,030,996, to Lustig and 2,656,917 to Hollis; United Kingdom Pat. Nos. 1,250,565, 1,487,365, 1,492,741, 1,492,742, 1,492,743, and 1,600,047; and United Kingdom Patent Application Nos. GB 2 041 743A and GB 2 055 741A, all of the foregoing United Kingdom patent properties being in the name of Allen Davies & Company. Despite the availability of numerous styles of product display cards, as exemplified by the foregoing disclosures, a need exists for a card construction that offers an optimal balance of product loading convenience and effectiveness, support for the mounted product, and facility of removal, when desired.

Accordingly, it is a principal object of the present invention to provide a novel card for mounting and displaying a multiplicity of bags of product, which card is loaded with relative facility, and provides a high degree of support for each of the bags without presenting undue inhibition to removal at the point of sale.

It is also an object of the invention to provide such a card which is of simple design, and is relatively inexpensive to produce and convenient to utilize.

SUMMARY OF THE INVENTION

It has now been found that the foregoing and related objects of the present invention are readily attained in a mounting card on which is provided a coacting pair of locking tabs formed therein by substantially identical mirror-image cut scores. Each tab of the pair is hingedly connected to the remainder of the card along a lower portion thereof, and is defined by inner, upper and outer edge portions. The inner edge portion of the tab extends upwardly from the inner end of the hinge to the upper edge portion thereof, and the outer edge portion extends downwardly and outwardly from the upper edge portion toward the outer edge of the tab hinge. The outer edge portions of the tabs of each pair are spaced from one another a distance that is substantially equal to, or less than, the width of the flange of the bag that is to be mounted thereby. As a result, the tabs can be displaced forwardly from the plane of the card to receive the folded flange of a bag thereover with its outer edge portions extending therebeyond; the tabs can thereafter be forced back through the plane of the card, to thereby cause the outer flange portions of the bag to engage behind the card, to effect secure mounting.

In certain embodiments, the outer edge portion of each tab will include a substantially rectilinear element inclined at an angle of about 45° to 75° (and preferably at least 60°) to the hinge; it may also include a lower element extending generally perpendicularly to the hinge. The upper edge portion of the tab may advantageously extend either at an acute angle to the hinge and at a right angle to the outer edge portion, or generally parallel thereto from the upper end of the tab inner edge portion. Particularly in the latter case, the outer edge portion will desirably include a substantially rectilinear inclined element which extends upwardly beyond, and returns to, the upper edge portion, to thereby define a supplemental locking nib on the tab.

Generally, the card will have a multiplicity of such locking tab pairs formed therein, to permit mounting of a multiplicity of bags. Most typically, the pairs of tabs on such a card will be arranged in a pattern of rows and columns.

DETAILED DESCRIPTION OF THE ILLUSTRATED EMBODIMENTS

Figure 1:
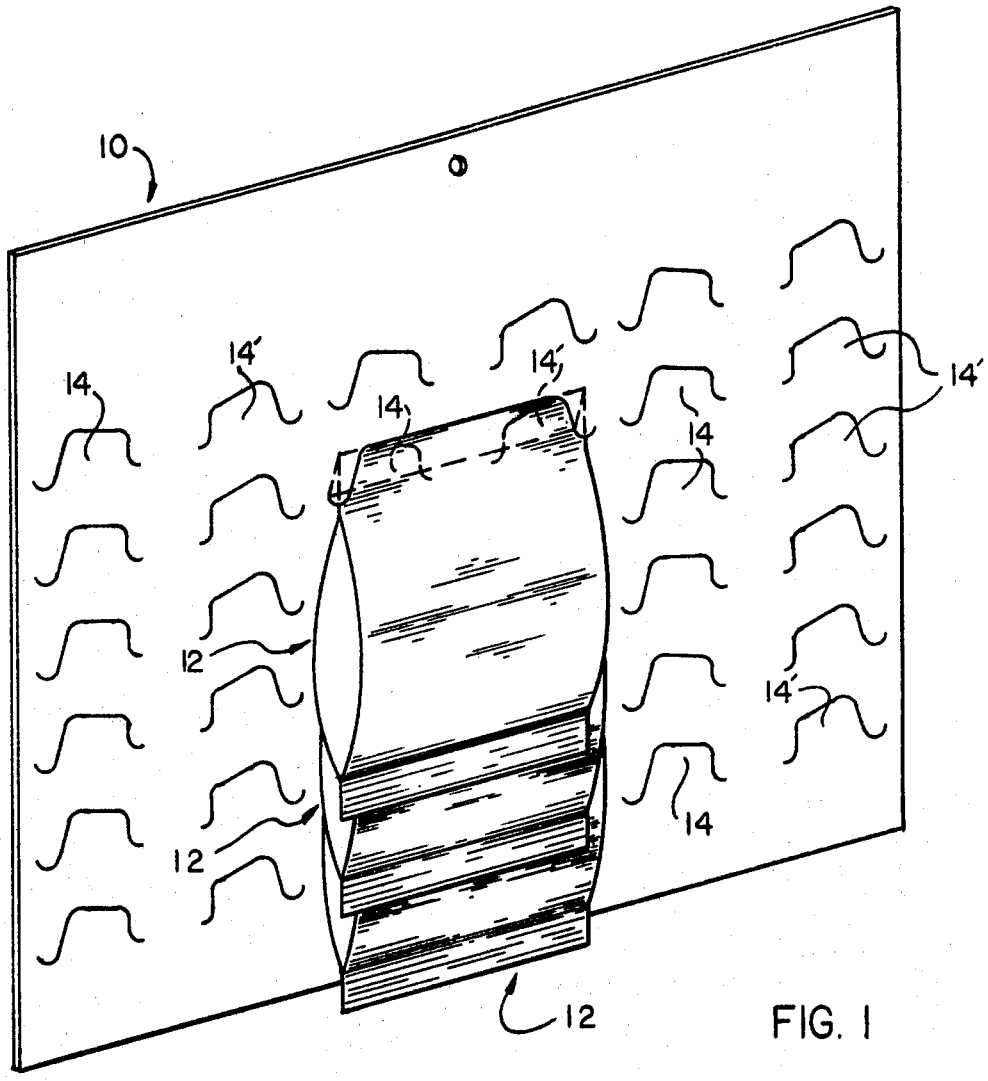
FIG. 1 is a perspective view of a product mounting and display card embodying the present invention, showing a partial column of bags mounted thereon, and showing the vacant locations in two other columns from which the bags have been removed.

Turning now in detail to FIG. 1 of the drawings, therein illustrated is a display card, generally designated by the numeral 10, embodying the present invention and having a multiplicity of product bags, generally designated by the numeral 12, mounted thereupon in shingled fashion. Each bag 12 is individually mounted by a matched pair of tabs 14, 14', a multiplicity of which pairs are formed in the card 10 by mirror-image cut score lines of compound configuration, and are joined thereto along integral hinge lines 16; the tab pairs 14, 14' are arranged in six rows and three columns.

Figure 2:
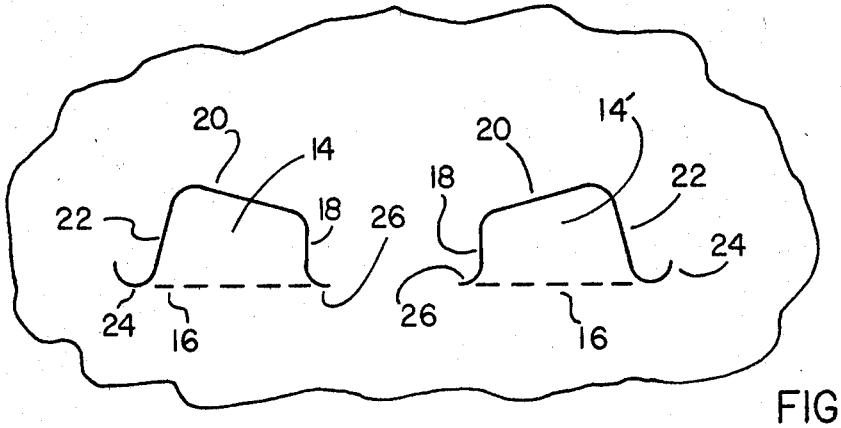
FIG. 2 is a fragmentary elevational view of one surface of the card of FIG. 1, drawn to an enlarged scale and showing the configuration of the cut scores and resultant locking tabs provided thereon.
Figure 3:
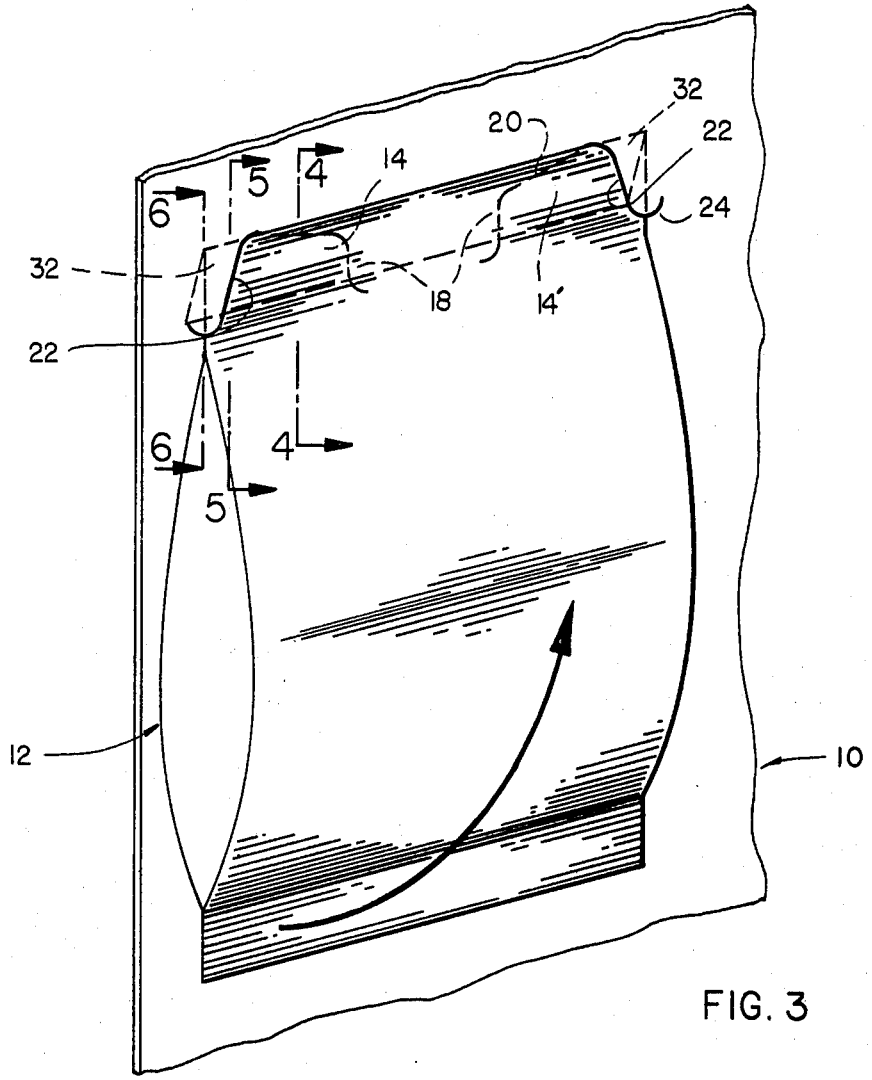
FIG. 3 is a fragmentary front elevational view showing a bag mounted upon the card, and drawn to substantially the scale of FIG. 2.
Figure 4:
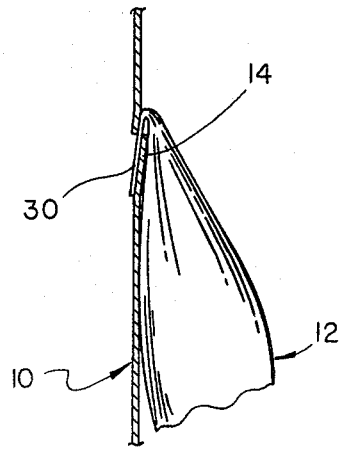
FIG. 4 is a fragmentary cross-sectional view of the bag mounted upon the card, taken along line 4—4 of FIG. 3.
Figure 5:
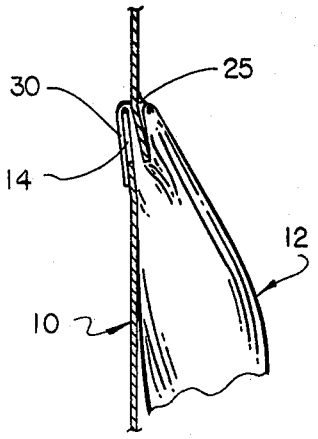
FIG. 5 is a view similar to FIG. 4, taken along line 5—5 of FIG. 3.
Figure 7:
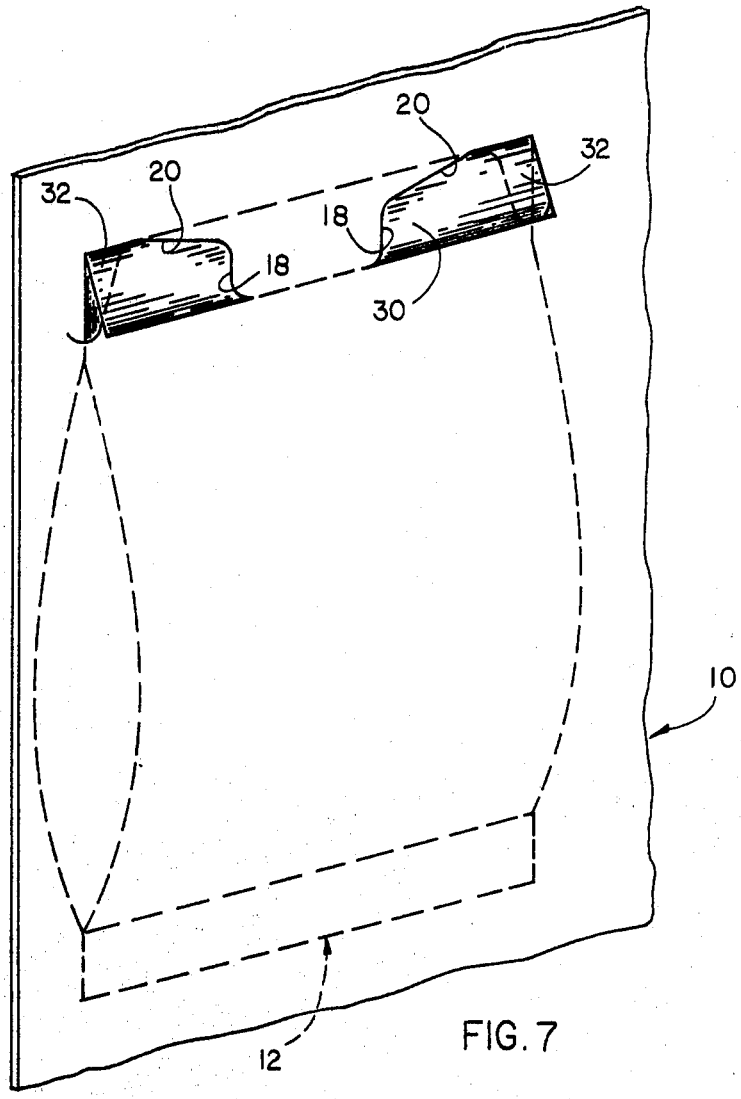
FIG. 7 is a rear elevational view of the card, showing the relationship between the bag flange and the locking elements of the card, drawn to the scale of FIG. 3.
Figure 6:
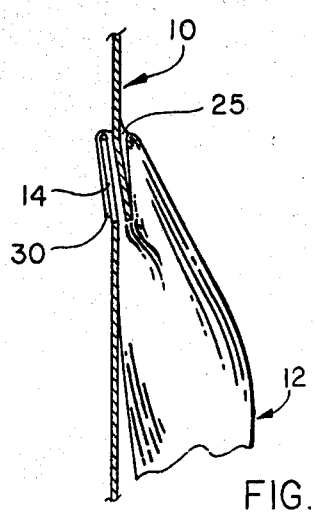
FIG. 6 is yet another similar view, taken along line 6—6 of the same Figure.

As best seen in FIG. 2, each tab 14, 14' is defined by a cut score which includes an inner element 18 that extends perpendicularly upwardly from the hinge line 16 and connects with a rectilinear, outwardly inclined upper element 20. A J-shaped score portion, consisting of a rectilinear element 22 and an outwardly curled hook element 24, is formed at the opposite end of the hinge line 16, and extends at an acute angle of about 75° thereto and generally perpendicularly to the upper element 20. The inner element 18 also terminates in a slight hook 26, the elements 24, 26 being provided to minimize tearing of the cardstock during flexure of the tabs 14, 14', in accordance with standard practice. As will be appreciated, the tabs 14, 14' are substantially disconnected from the remainder of the card 10 except at the hinge line 16, permitting displacement from the plane of the card thereabout.

The details of the relationships that exist upon mounting of the bags 12 upon the card 10 are best seen in FIGS. 3–7, wherein the upper flange portion 30 of the bag 12 has been reversely folded and inserted behind the tabs 14, 14'. With the tabs forced back through the plane of the card 10, the upper corner portions 32 along the fold in the bag are positioned behind the card 10, producing interengagement therebetween. It will, of course, also be true that the portions of the bag 12 that pass through the plane of the card 10 are gripped between the edges of the tabs 14, 14' and the corresponding edges of the card, marginal portions thereof being slightly distorted (as at 25) to accommodate the bag material. These combined effects securely mount the bags against inadvertent disassembly, while nevertheless permitting facile removal from the card at the point of sale, simply by exerting a natural upward pivoting action at a lower corner of the bag, as indicated by the curved arrow in FIG. 3.

Figure 8:
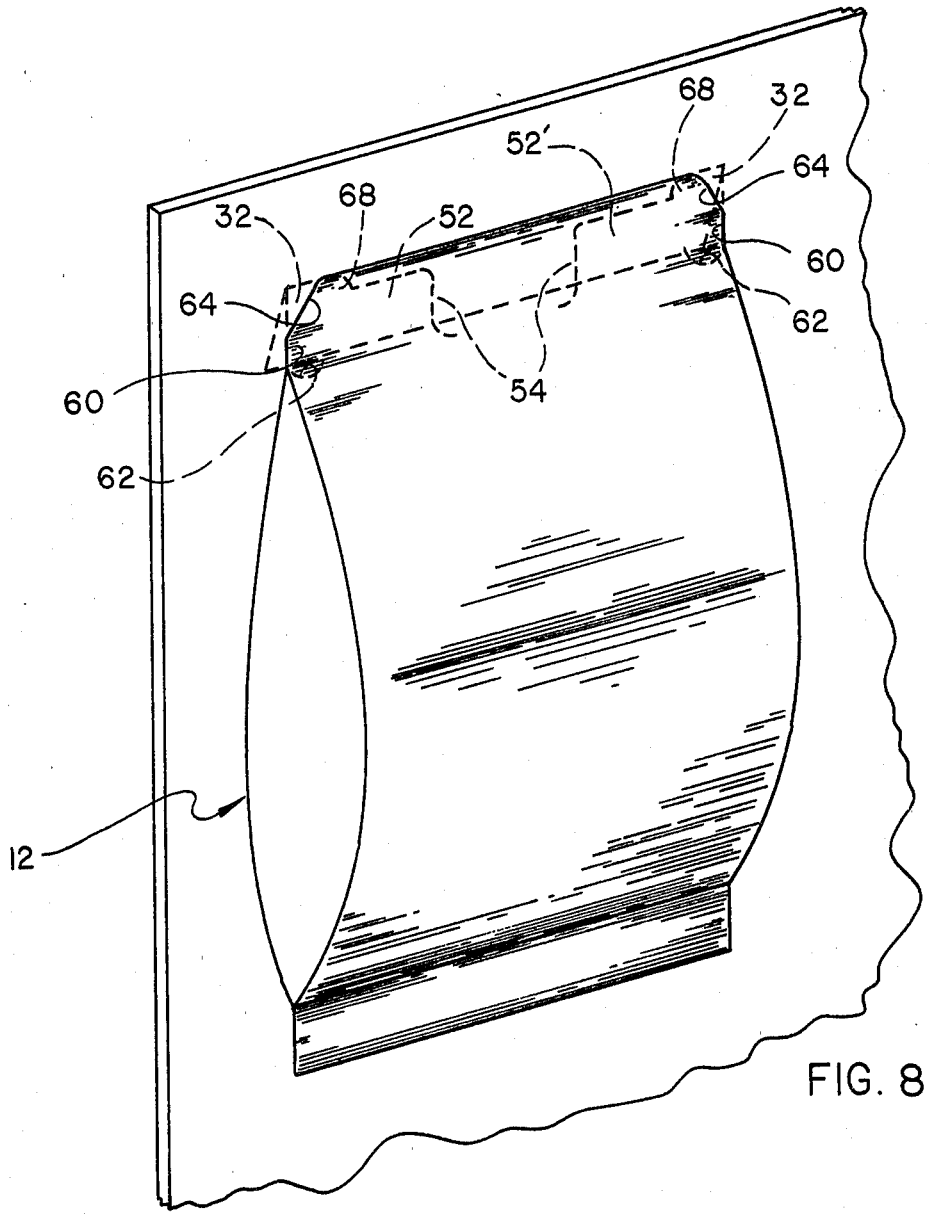
FIG. 8 is a view similar to that of FIG. 2, showing a second embodiment of cut scores and resultant locking tabs.
Figure 9:
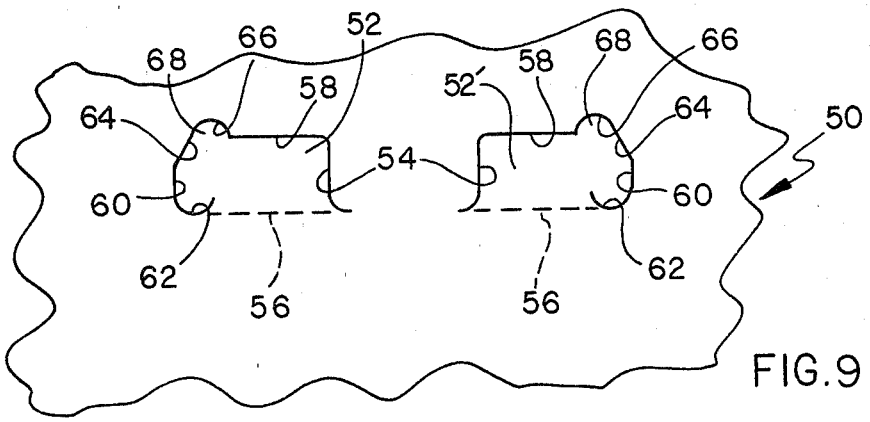
FIG. 9 is a view similar to that of FIG. 3, with respect to the second embodiment and showing a bag mounted on the card.

Turning now to FIGS. 8 and 9 of the drawings, a second embodiment of the invention is shown, and consists of a card, generally designated by the numeral 50, similar to card 10 and having matched sets of tabs 52, 52' (only one set being shown) formed therein by mirror image compound cut scores. Each score includes an inner element 54, extending perpendicularly upwardly from the hinge line 56 and connecting with an upper element 58, the latter extending outwardly therefrom and generally parallel to the hinge. A J-shaped score portion, consisting of a rectilinear element 60 and an inwardly curled element 62, is formed at the opposite end of the hinge line 56, to which the rectilinear element 60 is perpendicular. A rectilinear outer edge element 64 is inclined from the upper end of the element 60 (at an angle of about 60° to the hinge 56), passing beyond the upper element 58 and connecting therewith through a reversely curved portion 64; this defines a nib 66 on each of the tabs 52, 52'.

The mounted relationships of the parts of the bag 12 and tabs 52, 52' are much the same as those that exist with the tabs 14, 14', and so need not be described in detail. The principal difference results from the presence of the nibs 66, which tend to distort the engaged portion of the bag 12 and thereby exert an additional gripping effect thereupon, as is particularly desirable when the bag is fabricated from a relatively flaccid film or web. Not only does the pliancy of such a material lend itself better to deformation by the nib 66, but there is, of course, also some decrease in the holding force contribution of the underlying corner portions 32, due to the reduced rigidity of the material; the nib feature more than adequately compensates for any such loss, and it should, of course, be appreciated that the nib can be disposed elsewhere on the tab.

In addition to permitting facile removal and providing desirable support for the bag at two points rather than one (the latter having heretofore been the case), the mounting method of the present invention offers added aesthetic benefits. Not only is the straight, substantially unwrinkled upper edge of the bag more attractive, but the corner support provided by the present construction also leaves the central area, which is prevalently utilized for decoration or advertising of the product, unobstructed.

While not crucial to the concepts of the present invention, it will be understood that the display card itself will normally be produced from paperboard stock. It is conceivable, however, that other materials in web form might be utilized, including sheets of various plastics of adequate rigidity. Although mounting of the bags may be achieved manually, it will be much more advantageous to do so automatically, utilizing a suitable mechanism designed for the purpose.

While the present constructions will generally provide the optimal features described, it should be appreciated that the levels of support may vary considerably, depending upon many factors, including the paperboard webstock weight and grain direction, the bag material and, of course, the particular score configuration used. It should also be noted that the corner support constructions of the present invention offer particular advantage over the prior central support arrangements when the bags are relatively narrow and/or the tabs are of relatively small size.

The nature of the packaged product is, of course, similarly quite immaterial to the invention, there being numerous possibilities. As one example, however, it might be mentioned that peanuts and the like are typically packaged in bags constructed from foil laminates, the ends of which are crimped and sealed to provide flanges of the sort illustrated; such bags are particularly well-suited for point-of-sale merchandising, using the cards of the present invention. As has been pointed out, products packaged in flaccid films can also be supported effectively by the instant cards, the crimping nib feature being especially desirable in such instances.

Thus, it can be seen that the present invention provides a novel card for mounting and displaying a multiplicity of bags of product, which card is loaded with relative facility, and provides a high degree of support for each of the bags without presenting undue inhibition to removal at the point of sale. The card is of simple design, and is relatively inexpensive to produce and convenient to utilize.

Having thus described the invention, what is claimed is:

1. In a card for disengageably mounting a product-containing bag having a reversely-foldable, generally rectangular outer flange thereon, the improvement comprising: a coacting pair of locking tabs formed in said card by substantially identical mirror-image cut scores, each tab of said pair being hingedly connected to the remainder of said card along a lower portion thereof, and being defined by inner, upper and outer edge portions, said inner edge portion extending upwardly from the inner end of the hinge to said upper edge portion, and said outer edge portion extending downwardly and outwardly from said upper edge portion toward the outer end of said hinge, said outer edge portions of said tabs being spaced from one another a distance substantially equal to or less than the width of the bag flange, so that said tabs can be displaced forwardly from the plane of said card to receive the folded flange of a bag thereover with its outer end portions extending therebeyond, and can thereafter be forced back through said plane, with the bag carried thereon, to cooperatively engage the outer flange portions behind said card to securely mount the bag.

2. The card of claim 1 wherein said outer edge portion of said tab includes a substantially rectilinear inclined element.

3. The card of claim 2 wherein said inclined element is disposed at an angle of about 45° to 75° to said hinge.

4. The card of claim 2 wherein said outer edge portion also includes an element extending generally perpendicularly to said hinge, downwardly from the outer end of said inclined element.

5. The card of claim 1 wherein said upper edge portion of said tab is substantially rectilinear and is outwardly inclined at an acute angle to said hinge.

6. The card of claim 5 wherein said outer and upper edge elements are disposed at substantially a right angle to one another.

7. The card of claim 1 wherein said upper edge portion of said tab extends generally parallel to said hinge, outwardly from the upper end of said inner edge portion.

8. The card of claim 7 wherein said outer edge portion includes a substantially rectilinear inclined element extending upwardly beyond and returning to said upper edge portion, thereby defining a supplemental locking nib on said tab.

9. The card of claim 1 having a multiplicity of said locking tab pairs formed therein, for mounting a multiplicity of such bags thereon.

10. The card of claim 9 wherein said pairs of tabs are arranged in a pattern of rows and columns.

11. In a card for disengageably mounting a product-containing bag having a reversely-foldable, generally rectangular outer flange thereon, the improvement comprising: a multiplicity of coacting pairs of locking tabs formed in said card by substantially identical mirror-image cut scores, each tab of each of said pairs being hingedly connected to the remainder of said card along a lower portion thereof, and being defined by inner, upper and outer edge portions, said inner edge portion extending upwardly from the inner end of the hinge, and substantially perpendicularly thereto, to said upper edge portion, said upper edge portion extending substantially parallel to said hinge, and said outer edge portion extending downwardly and outwardly from said upper edge portion toward the outer end of said hinge, said outer edge portion including a substantially rectilinear inclined element and an element extending generally perpendicularly to said hinge downwardly from the outer end of said inclined element, said generally perpendicular elements being spaced from one another a distance substantially equal to the width of the bag flange, so that tabs of each pair can be displaced forwardly from the plane of said card to receive the folded flange of a bag thereover with its outer end portions extending therebeyond, and can thereafter be forced back through said plane, with the bag carried thereon, to cooperatively engage the outer flange portions behind said card to securely mount the bag.

12. The card of claim 11 wherein said substantially rectilinear inclined element extends upwardly beyond and returns to said upper edge portions, thereby defining a supplemental locking nib on said tab.

13. In a card for disengageably mounting a product-containing bag having a reversely-foldable, generally rectangular outer flange thereon, the improvement comprising: a multiplicity of coacting pairs of locking tabs formed in said card by substantially identical mirror-image cut scores, each tab of each of said pairs being hingedly connected to the remainder of said card along a lower portion thereof, and being defined by substantially rectilinear inner, upper and outer edge portions, said inner edge portion extending upwardly from the inner end of the hinge, and substantially perpendicularly thereto, to said upper edge portion, said upper edge portion extending upwardly at an acute angle to said hinge, and said outer edge portion extending downwardly and outwardly from said upper edge portion toward the outer end of said hinge, said outer edge portions of said tabs being spaced from one another by a maximum a distance that is less than the width of the bag flange, so that said tabs of each pair can be displaced forwardly from the plane of said card to receive the folded flange of a bag thereover with its outer end portions extending therebeyond, and can thereafter be forced back through said plane, with the bag carried thereon, to cooperatively engage the outer flange portions behind said card to securely mount the bag.

14. The card of claim 13 wherein said outer edge element is disposed at an angle of about 45° to 75° to said hinge.

15. The card of claim 14 wherein said outer and upper edge elements are disposed at substantially a right angle to one another.

* * * * *